US007137928B1

(12) United States Patent
Chen

(10) Patent No.: US 7,137,928 B1
(45) Date of Patent: Nov. 21, 2006

(54) STEP EXERCISER

(75) Inventor: Chih-Hsien Chen, Taichung (TW)

(73) Assignee: Qiao Gang Enterprise Co., Ltd., Taichung (TW)

( * ) Notice: Subject to any disclaimer, the term of this patent is extended or adjusted under 35 U.S.C. 154(b) by 0 days.

(21) Appl. No.: 11/089,320

(22) Filed: Mar. 24, 2005

(51) Int. Cl.
*A63B 22/04* (2006.01)

(52) U.S. Cl. ..... 482/53; 482/52

(58) Field of Classification Search ..... 482/52–53
See application file for complete search history.

(56) References Cited

U.S. PATENT DOCUMENTS 5,545,111 A * 8/1996 Wang et al. ..... 482/53
5,628,709 A * 5/1997 Chen ..... 482/53
5,888,175 A * 3/1999 Chang ..... 482/53
6,102,833 A * 8/2000 Chen ..... 482/53
6,582,344 B1 * 6/2003 Tang ..... 482/53
6,709,367 B1 * 3/2004 Liang ..... 482/53
6,712,739 B1 * 3/2004 Chen ..... 482/53

* cited by examiner

*Primary Examiner*—Stephen R. Crow
(74) *Attorney, Agent, or Firm*—Alan D. Kamrath; Nikolai & Mersereau, P.A.

(57) ABSTRACT

A step exerciser has a base, a pedal element pivotally mounted on the base, and having a first female hollow shank pivotally mounted on the base, two pedals mounted on two opposed sides of and pivoted relative to the first female hollow shank, an interconnection element connected between the pedals and the first female hollow shank, and a damping element provided on the pedal element. Hence, the step exerciser can provide a user with various exercise effects.

10 Claims, 7 Drawing Sheets

STEP EXERCISER

BACKGROUND OF THE INVENTION

1. Field of the Invention

The present invention relates to a step exerciser and, more particularly, to a step exerciser which can be rotated freely to provide multiple sports functions for a user.

2. Description of Related Art

A conventional step exerciser is an exercise machine popular with users who can tread on pedals thereof to imitate walking and thereby achieve an exercise effect.

However, the conventional step exerciser can only provide the user with one walking method such that it is not enough to meet the user's requirement of interesting and varied exercises.

Therefore, the invention provides a step exerciser to mitigate or obviate the aforementioned problems.

SUMMARY OF THE INVENTION

The main objective of the present invention is to provide a step exerciser which can be rotated freely to meet the user's requirement of various exercises.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
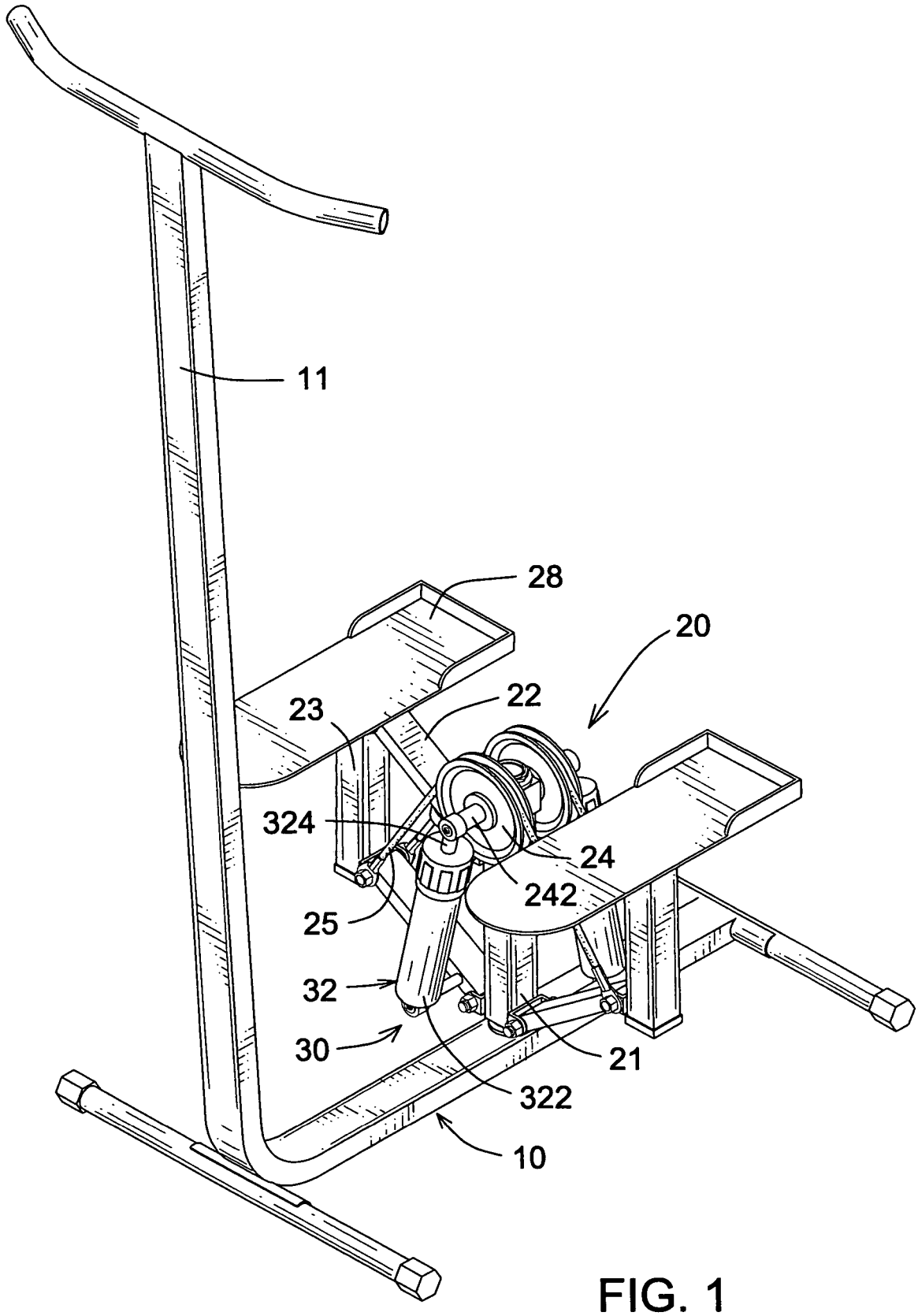
FIG. 1 is a perspective view of a step exerciser in accordance with the present invention.
Figure 2:
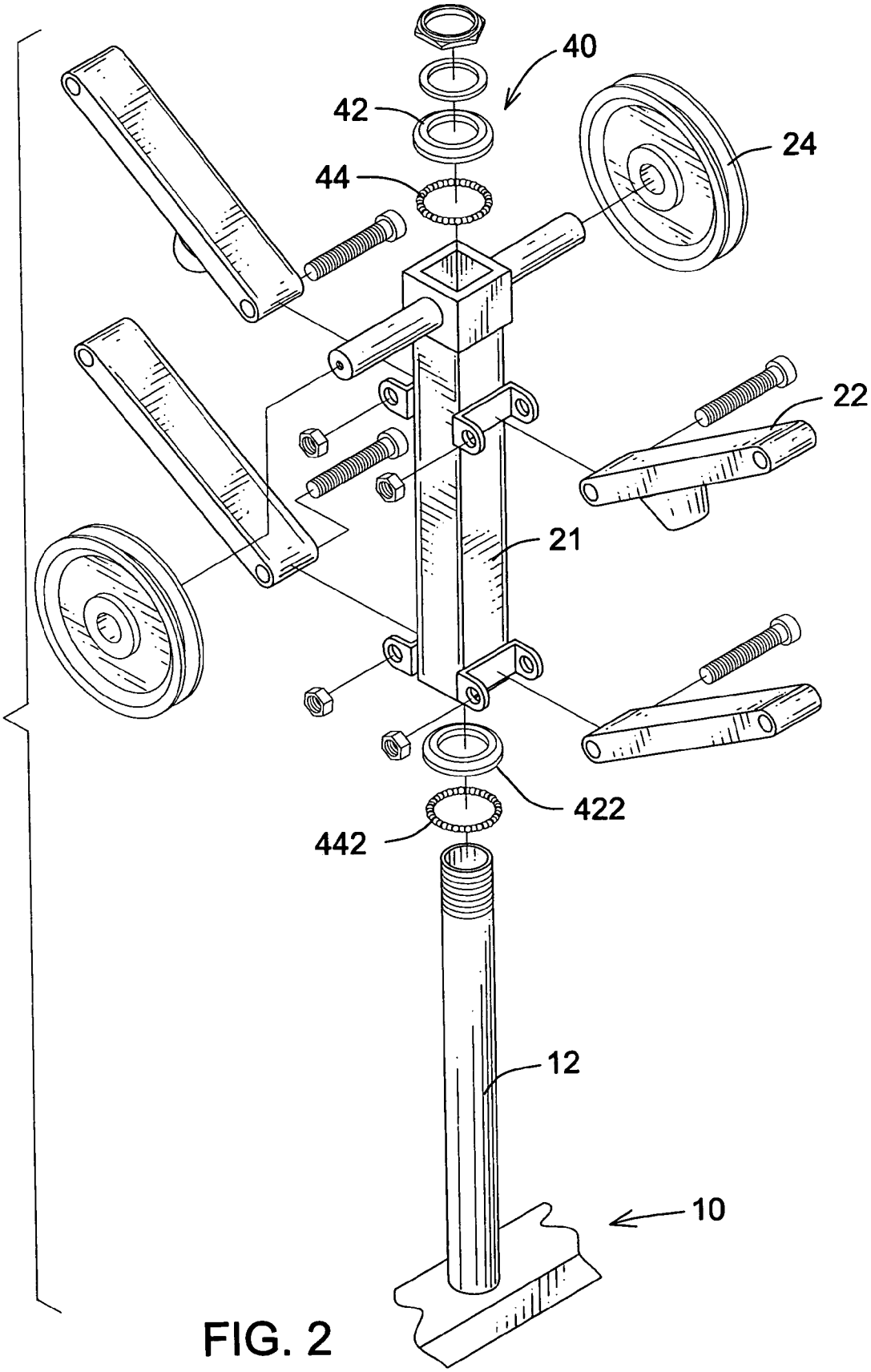
FIG. 2 is an exploded perspective view of a pedal element of the step exerciser in accordance with the present invention.
Figure 3:
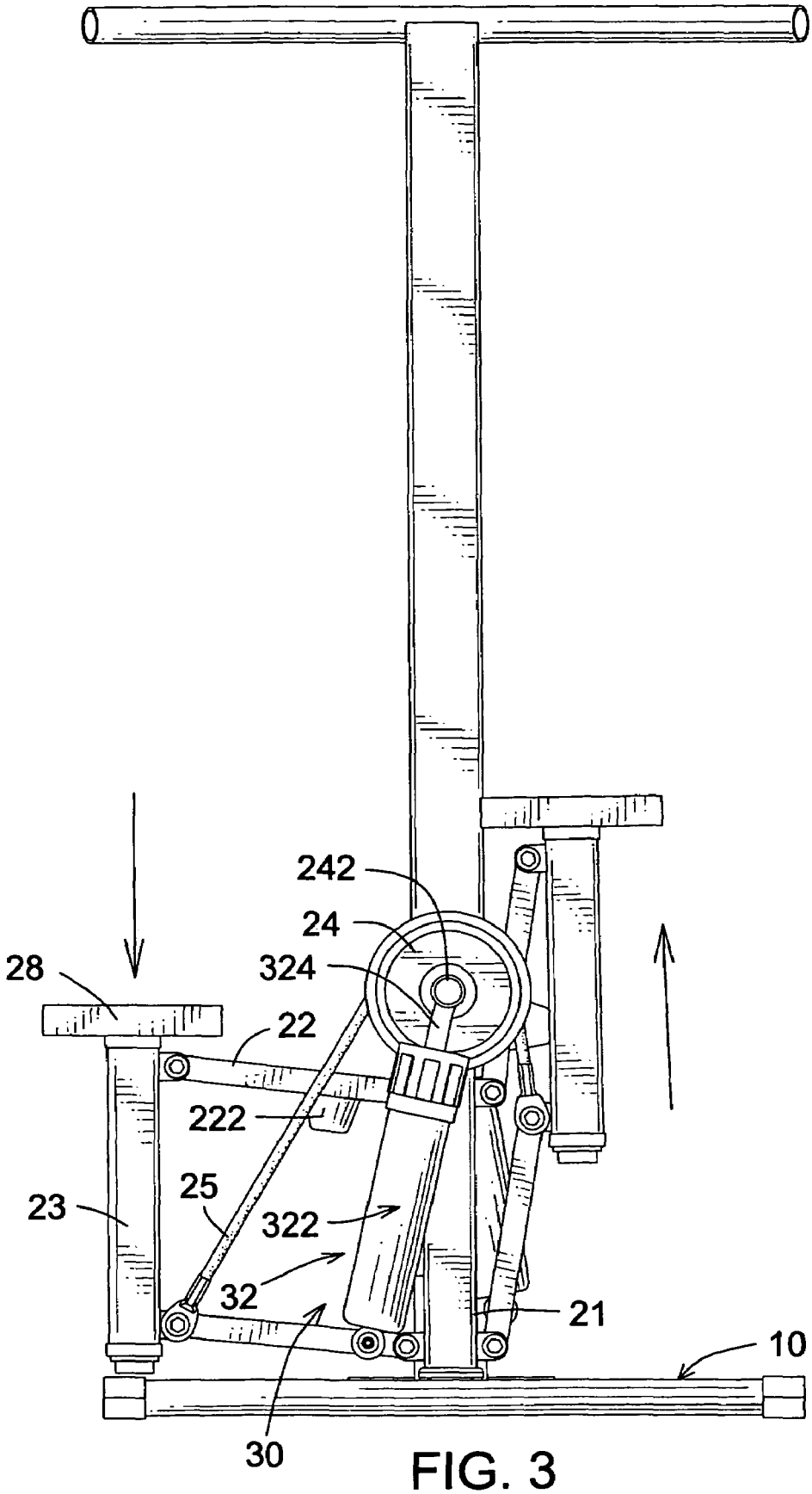
FIG. 3 is a side view of the step exerciser in accordance with the present invention.

With reference to FIGS. 1–3, a step exerciser comprises a base (10), a handle bar (11) provided upright on a first end of the base (10), and a pedal element (20) provided on a second end of the base (10). The pedal element (20) is composed of a first female hollow shank (21) pivotally mounted on the base (10), and two pedals (28), respectively, provided on two sides of the first female hollow shank (21). An interconnection element, which can enable the pedals (28) to interlock each other, is provided between the pedals (28) and the first female hollow shank (21). The interconnection element has two pairs of transverse levers (22), two second female hollow shanks (23), two wheels (24) and two cables (25). Each pair of the transverse levers (22) is pivotally mounted between two lateral sides of the first female hollow shank (21) and the associated second female hollow shank (23), and are parallel to each other. The second female hollow shanks (23), which are parallel to each other, respectively interlock and are parallel to the first female hollow shank (21) due to the transverse levers (22) being connected with the first and the second female hollow shanks (21, 23). The pedals (28) are mounted on a top end of each second female hollow shank (23). The parallel wheels (24) are, respectively, mounted on a top end of the first female hollow shank (21) via an axle (242) thereof being pivotally and transversely mounted on the first female hollow shank (21). The cables (25) are reeled, respectively, around the wheels (24), and each has two ends, respectively, connected to the transverse levers (22).

A damping element (30), which is provided on the pedal element (20), has two pneumatic cylinders (32), each of which is pivotally mounted on the transverse levers (22). Each pneumatic cylinder (32) includes a barrel (322) and a rod (324). The rods (324), each of which can move relative to the barrel (322), is pivotally connected to the axle (242), so that the barrels (322) slide corresponding to the rods (324) to generate an effect of damping when the pedal element (20) is working.

Figure 4:
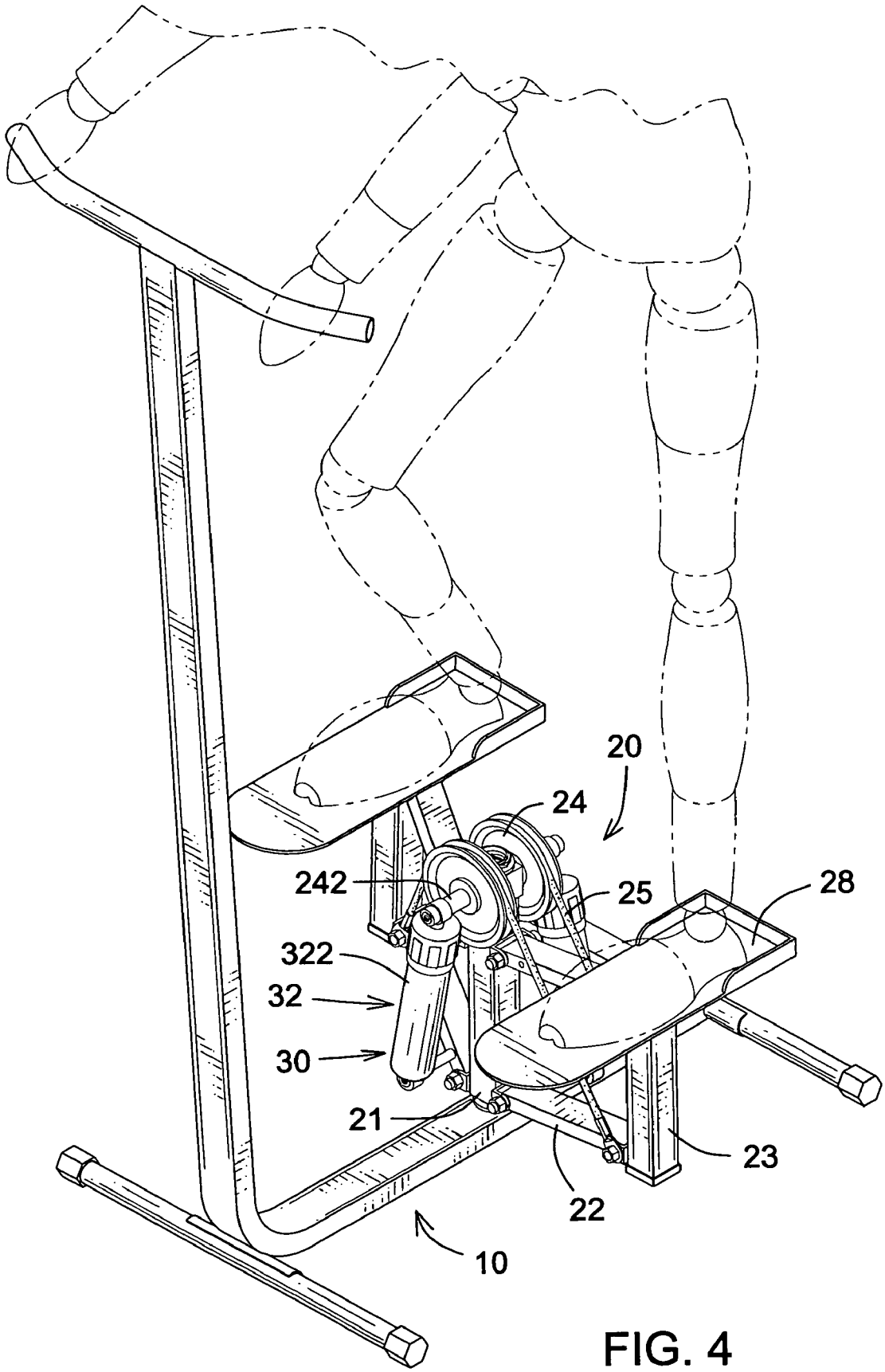
FIG. 4 is a perspective view of the step exerciser in accordance with the present invention in usage.
Figure 5:
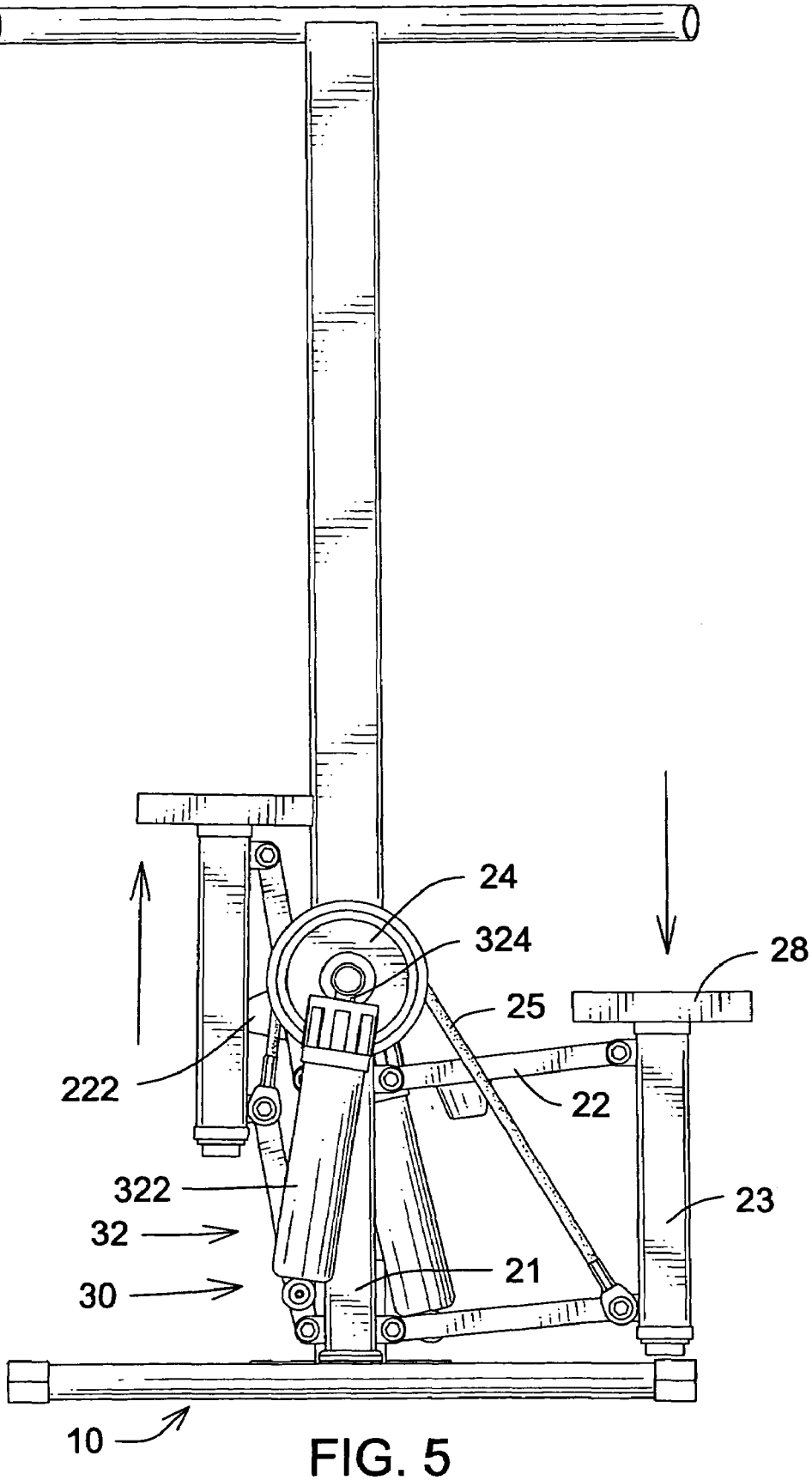
FIG. 5 is a side view of the step exerciser in accordance with the present invention in usage.

With reference to FIGS. 4–5, when a user tramps on the pedals (28), one of the pedals (28) moves downwards so that the pair of the transverse levers (22) corresponding to the lower pedal (28) pivotally rotates downwards relative to the first female hollow shank (21). Meanwhile, the cable (25) is under tension due to the lower pair of the transverse levers (22) and therefore, the other pair of the transverse levers (22) moves upwards relative to the first female hollow shank (21). Hence, the other pedal (28) corresponding to the high pair of the transverse levers (22) moves upwards so that the pedals (28) can move up and down in turn to imitate walking. Furthermore, the damping element (30) provides the user with a damping effect to enhance exercise difficulty.

With reference to FIGS. 3 and 5, two lugs (222) are, respectively, mounted on the top transverse levers (22). When the user is exercising, each of the lugs (222) can, respectively, attach to the second female hollow shank (23) in one side to limit the moving extent of the pedals (28) and enable the user to use the present invention conveniently.

Figure 6:
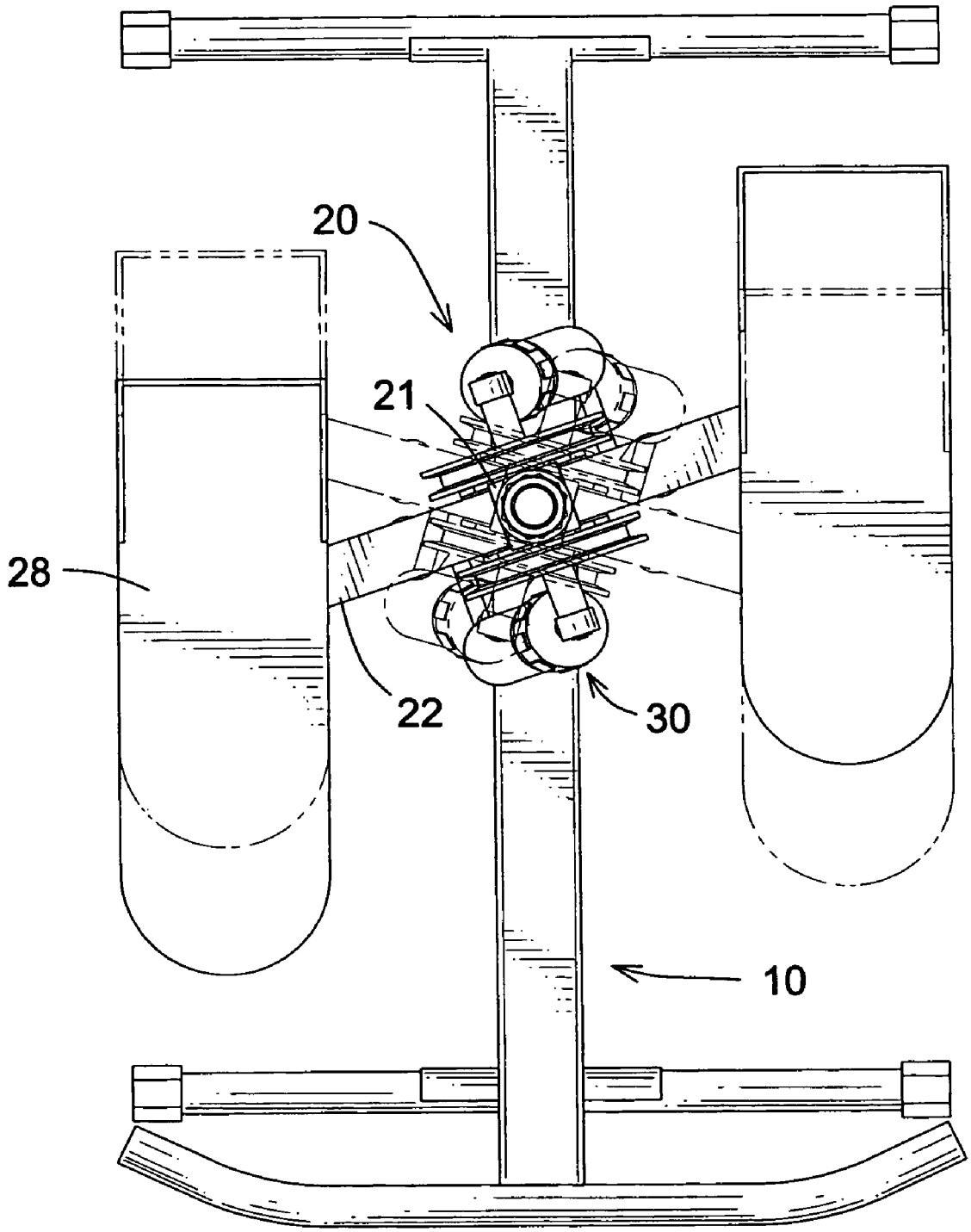
FIG. 6 is a top view view of the pedal element of the step exerciser in accordance with the present invention being rotated relative to a base.

Furthermore, with the reference to FIG. 6, the first female hollow shank (21) is pivotally mounted on the base (10) so that the pedal element (20) can turn right or left relative to the base (10) due to the movement of the user such as twisting the waist to achieve different effects of exercise.

With reference to FIGS. 1–2, a post (12) is securely provided on and perpendicular to the base (10). The first female hollow shank (21) is pivotally mounted around the post (12) and has two bearing elements (40) mounted on two opposed ends thereof. The two bearing elements (40), respectively, have a first cap (42) which is threaded and a second cap (422). A first ball race (44) attaches to the first cap (42) which is threadingly engaged with a threaded top end of the post (12), and a second ball race (442) attaches to the second cap (422) and is mounted adjacent to the base (10). The second cap (422) is securely mounted on a lower end of the fiat female hollow shank (21). Hence, the first female hollow shank (21) can rotate relative to the post (12) in a low friction manner due to the first and the second ball races (44, 442).

Figure 7:
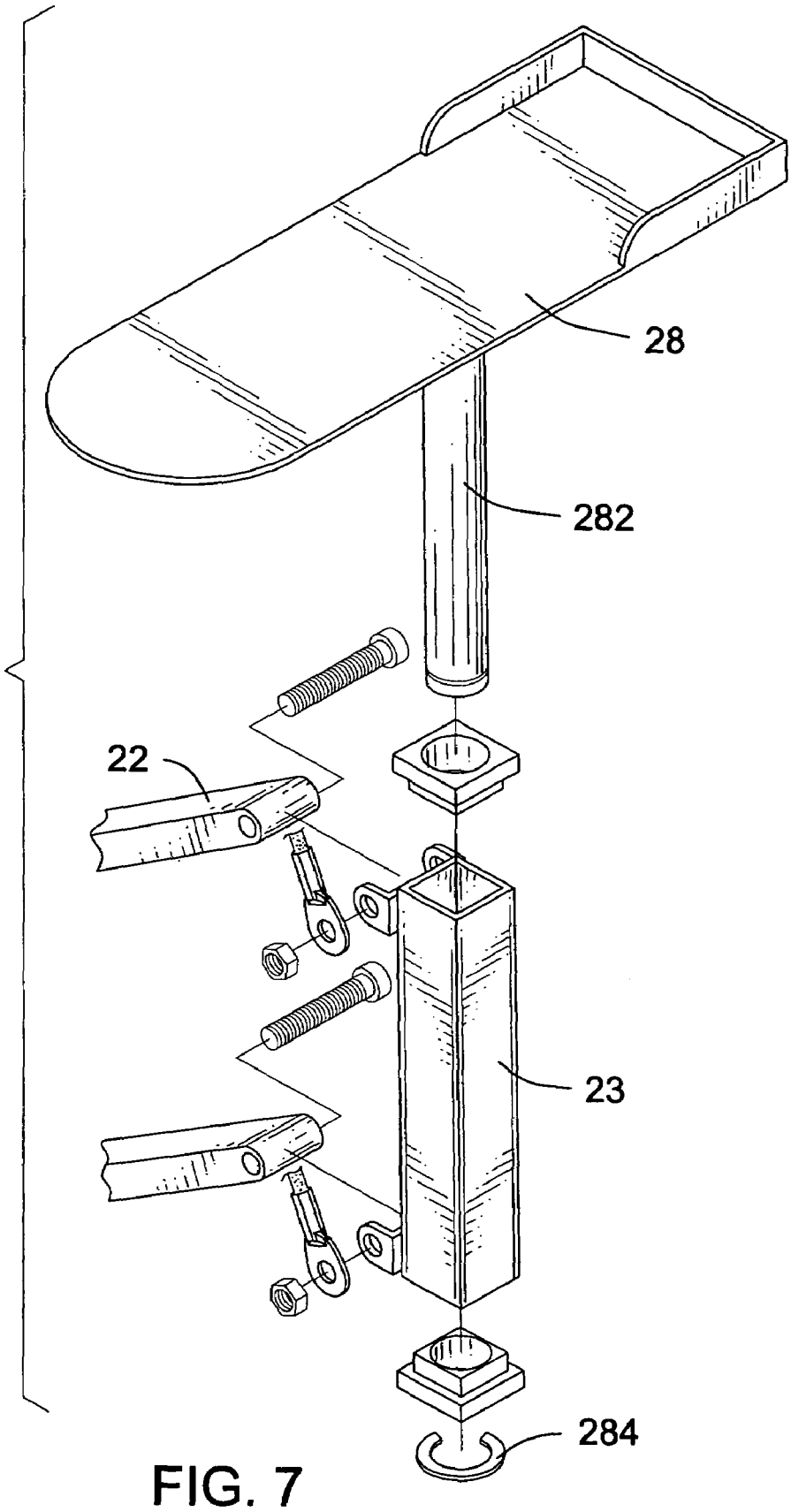
FIG. 7 is an exploded perspective view of a pedal and a post of the step exerciser in accordance with the present invention.

With reference to FIG. 7, two columns (282), each of which is securely provided below the pedal (28), are, respectively, inserted into and rotationally mounted in the second female hollow shanks (23) due to fasteners such as C-like fasteners (284). With reference to FIGS. 6 and 7, when the pedal element (20) rotates relative to the base (10), the pedals (28) also can rotate relative to the second female hollow shanks (23) and therefore, feet of the user can keep forward relative to his or her body. Hence, ankles and knees of the user can rotate with the rotation of the pedal element (20) to enhance the exercise effect. Furthermore, the user can twist at the waist and the ankles and knees without stamping up and down.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A step exerciser comprising:

a base:

a pedal element pivotally mounted on a first end of the base and having a first female hollow shank rotatably mounted on the base, two pedals respectively connected on two opposed sides of and pivoted relative to the first female hollow shank, an interconnection element mounted between the pedals and the first female hollow shank; and a damping element provided on the pedal element, wherein the interconnection element has two pairs of transverse levers, each pair of which is provided on a lateral side of the first female hollow shank and parallel to each other, two second female hollow shanks which are respectively connected to the lateral sides of and parallel to the first female hollow shank via two transverse levers in one side transversely connecting between the first female hollow shank and the second female hollow shanks two wheels which are rotatably mounted on the first female hollow shank via an axle, and two cables reeling respectively around the wheels and each having two ends respectively connected to lower transverse levers of the two pairs of transverse levers.

2. The step exerciser as claimed in claim 1, wherein the damping element has two pneumatic cylinders, each of which has a barrel provided on one of the lower transverse levers and a rod which is moveable relative to the barrel and connects to the axle.

3. The step exerciser as claimed in claim 1, wherein two columns, each of which is securely provided below the respective pedal, are respectively inserted into and rotationally mounted in the second female hollow shanks, whereby each pedal is pivotally mounted on the respective second female hollow shank.

4. The step exerciser as claimed in claim 1, wherein an upright post is securely mounted on the base, and the first female hollow shank is rotationally inserted over the post and provided with two bearing elements respectively mounted on two ends thereof.

5. The step exerciser as claimed in claim 4, wherein the two bearing elements respectively have a first and a second cap and a first and a second ball race, the first ball race attaches to a top end of the first female hollow shank and adjacent to the first cap, the second ball race attaches to the base and adjacent to the second cap which is securely mounted on a lower end of the first female hollow shank.

6. The step exerciser as claimed in claim 5, wherein two columns, each of which is securely provided below the respective pedal, are respectively inserted into and rotationally mounted in the second female hollow shanks, whereby each pedal is pivotally mounted on the respective second female hollow shank.

7. The step exerciser as claimed in claim 6, wherein a handle bar is mounted on a second end of the base.

8. The step exerciser as claimed in claim 7, wherein two lugs are respectively mounted on top transverse levers of the two pairs of transverse levers.

9. The step exerciser as claimed in claim 3, wherein a handle bar is mounted on a second end of the base.

10. The step exerciser as claimed in claim 9, wherein two lugs are respectively mounted on top transverse levers of the two pairs of transverse levers.

* * * * *